United States Patent [19]

Henriot et al.

[11] 4,455,540

[45] Jun. 19, 1984

[54] BAND PASS FILTER WITH LINEAR RESONATORS OPEN AT BOTH THEIR EXTREMITIES

[75] Inventors: Marie C. Henriot; Patrick Janer, both of Paris, France

[73] Assignee: Thomson-CSF, Paris, France

[21] Appl. No.: 400,488

[22] Filed: Jul. 21, 1982

[30] Foreign Application Priority Data

Jul. 24, 1981. [FR] France ..... 81 14426

[51] Int. Cl.[3] ..... H01P 1/203; H01P 7/08

[52] U.S. Cl. ..... 333/202; 333/204; 333/205; 333/235; 333/246

[58] Field of Search ..... 333/202, 204–207, 333/220, 221, 219, 245, 235, 246

[56] References Cited

U.S. PATENT DOCUMENTS

| | | | |
|---|---|---|---|
| 2,196,272 | 4/1940 | Peterson | 333/202 |
| 2,248,751 | 7/1941 | Frankel | 333/202 X |
| 2,945,195 | 7/1960 | Matthaei | 333/204 |

OTHER PUBLICATIONS

Reiter et al., "Stripline Filters with Coupled λ/8 Line Sections", 1973 European Microwave Conference, vol. I, Brussels, Belgium (Sep. 4–7, 1973), 4 pages.

IEEE Transactions on Microwave Theory and Techniques, vol. MTT-22, No. 5, May 1974; pp. 499–504.

Archiv fur Elektronik und Ubertragungstechnik, vol. 29, No. 11, Nov. 1975, pp. 461–464.

IEEE Transactions on Microwave Theory and Techniques, vol. MTT-22, No. 12, Dec. 1974, pp. 1312–1316.

*Primary Examiner*—Marvin L. Nussbaum

*Attorney, Agent, or Firm*—Oblon, Fisher, Spivak, McClelland & Maier

[57] ABSTRACT

A band-pass filter comprising n principal linear resonators open at both their extremities, has integrated therewith a band suppressor function by means of p auxiliary linear resonators (p being an integer comprised between 0 and n+1), tuned to a frequency which is to be rejected and respectively connected to p resonators of the n principal resonators at a point situated close to the middle of the principal resonator in question.

4 Claims, 6 Drawing Figures

BAND PASS FILTER WITH LINEAR RESONATORS OPEN AT BOTH THEIR EXTREMITIES

BACKGROUND OF THE INVENTION

The present invention relates to pass band filters produced by means of linear resonators open at both their extremities, such as hairpin resonators, also referred to as U resonators, and such as the straight resonators formed by straight line sections. On this subject, it is recalled that these resonators, which are also referred to as λ2 resonators, being open at both their extremities, resonate at a frequency which within the filter corresponds to a wavelength λ equal to twice the electric length of the resonators. The pass band of the filter is centered on this resonance frequency.

Commonly speaking for filtration problems, and in particular for filters comprising linear resonators open at both their extremities, if it is intended to add to a pass band function a band cutout or suppressor function, for example to eliminate an undesirable frequency, a band suppressor filter is installed in series with the band pass filter. This has the disadvantage of requiring two filters and thus of requiring space and of being expensive.

The object of the present invention is to eliminate the need to utilize two filters.

This is obtained by integrating a band suppressor function within an existing band pass filter.

SUMMARY OF THE INVENTION

In accordance with the invention, there is provided a band pass filter comprising n resonators of the λ/2 type (n:positive integer; λ: mean wavelength of the pass band in the filter), each having two open extremities and a middle, this middle being the point of the resonator at which the electric field has its minimum value, and p auxiliary resonators, each having a resonance frequency which is a frequency to be rejected by reason of this auxiliary resonator, and in which the p auxiliary resonators are respectively connected close to the middle of p of the n λ/2 type resonators.

BRIEF DESCRIPTION OF THE DRAWINGS

A better understanding of the invention will be gained and other features will emerge from the following description and accompanying drawings, in which.

DESCRIPTION OF THE PREFERRED EMBODIMENTS

The corresponding elements bear the same reference symbols in the differeint figures.

Figure 1:
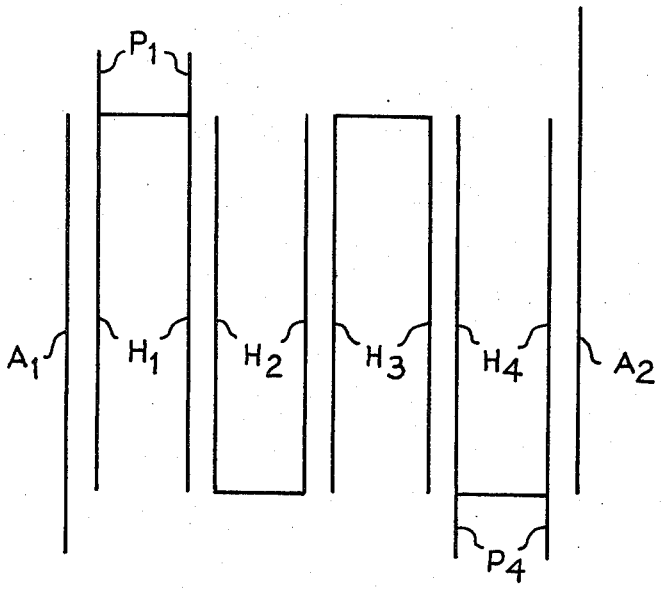
FIGS. 1 to 4 illustrate diagrams of embodiments of filters according to the invention.

FIG. 1 is a diagrammatic view of a band pass filter produced by means of U resonators. The filter comprises two mutually parallel access lines $A_1A_2$ and, between these two lines, four U resonators $H_1$ to $H_4$, of which the vertical bars of the U are parallel to the lines $A_1A_2$. The length of the U resonators $H_1$ to $H_4$ amounts to λ/2 (λ being the wavelength corresponding to the mean frequency of the pass band of the band pass filter). The resonators $H_1$ and $H_4$ have associated with them, respectively, two U resonators $P_1$ and $P_4$, of which the length is equal to λ'/2 (λ' being a wavelength corresponding to a frequency which is to be rejected in the filter).

In the filter according to FIG. 1, as moreover in the filters which will be described in the following, the access means such as $A_1$ and $A_2$ and the resonators such as $H_1$ and $H_4$ and $P_1$,$P_4$ are formed by metal deposits situated on one of the surfaces of a dielectric substrate of which the other surface is covered by a metal sheet forming an earthing plane. The dielectric substrate and the metal sheet do not appear in FIG. 1 in order to simplify the illustration.

The arrangement of FIG. 1 without the resonators $P_1$ and $P_4$, corresponds to a band pass filter of conventional type. In a filter of this kind, the coupling coefficient present between two resonators is defined by their mutual spacing, by their line width and by the distance separating the two branches of one and the same resonator. The resonators being open at both their extremities, their resonance frequency is the frequency corresponding to the wavelength λ in the filter, in which λ is equal, as stated in the foregoing, to twice the length of the resonators $H_1$ to $H_4$.

A band suppressor or arrester function has been obtained in the filter according to FIG. 1 by means of the two U resonators $P_1$ and $P_4$ which are positioned respectively to back the resonators $H_1$ and $H_4$, that is to say placed in such a manner that the horizontal bar of the U is shared with that of the resonators $H_1$ and $H_4$. Thus, being positioned at the point at which the electric field is at its minimum value in the resonators $H_1$ and $H_4$, the resonators $P_1$ and $P_4$ cause practically no modification of the characteristics of the band pass filter obtained due to the resonators $H_1$ and $H_4$, and these resonators $P_1$ and $P_4$ act like a band suppressor filter connected in series with the band pass filter.

Figure 2:
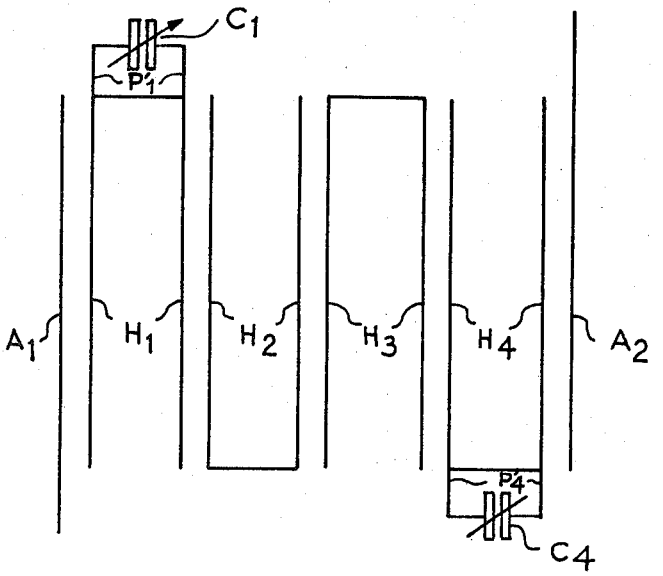

Another possible embodiment of the filter according to the invention is shown by FIG. 2 which is a diagram differing from that of FIG. 1 only in that the resonators $P_1$ and $P_4$ are replaced by resonators of lesser length $P'_1$,$P'_4$, but of which the extremities are respectively connected to two variable capacitors $C_1$,$C_4$ adjusted in such manner as to impart to the assemblies $P'_1C_1$ and $P'_4C_4$ an electric length equal to half the wavelength λ' referred to in respect of FIG. 1 (λ' being the wavelength in the filter corresponding to the frequency to be rejected by the filter).

Figure 3:
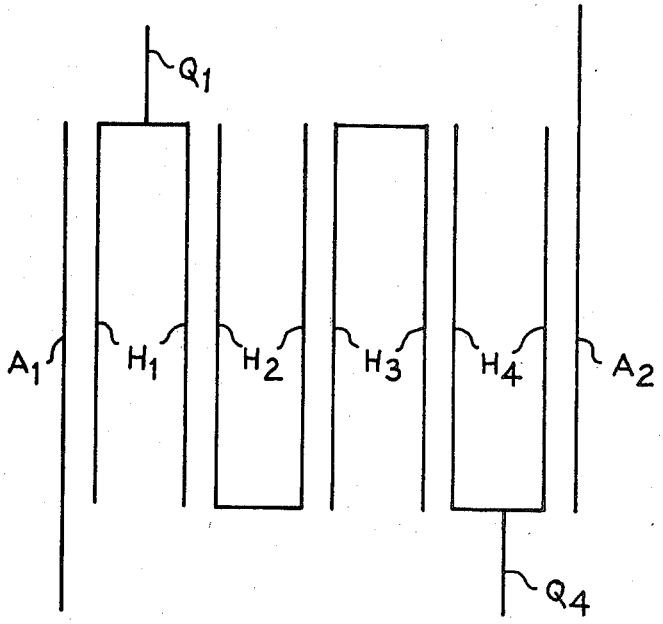

FIG. 3 is a diagram of another embodiment of filter differing from the filter of FIG. 1 by replacing the U-type resonators $P_1$ and $P_4$ by two single resonators $Q_1Q_4$, that is to say by resonators of which each has only one of its extremities isolated. At their other extremity, these two single resonators are connected respectively substantially to the middle of the horizontal bar of the resonators $H_1$ and $H_4$. These single resonators $Q_1$ and $Q_4$ are formed by line sections having a length λ'/4, in which λ' is the wavelength in the filter corresponding to the frequency which is to be rejected. A concrete embodiment of a filter of this kind will be given with reference to FIG. 5 and 6.

Figure 4:
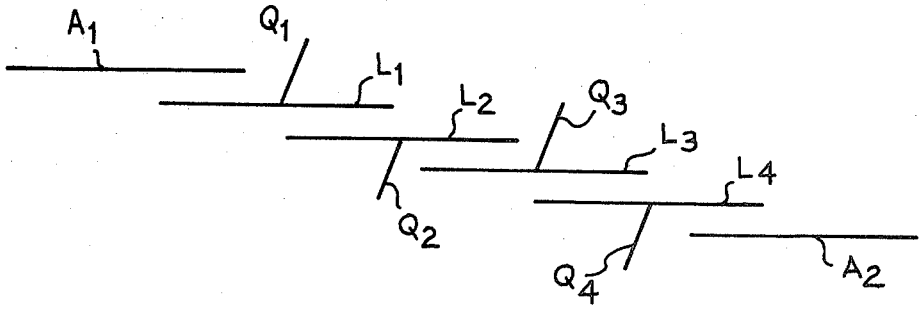

The invention is not applicable solely to filters of the band pass type comprising U resonators, and it is equally applicable, as is apparent from FIG. 4, to band pass filters comprising parallel lines. FIG. 4 shows a filter of this kind; this filter comprises an input line $A_1$ and an output line $A_2$ which are mutually parallel, and between these lines four straight resonators $L_1$ to $L_4$ of a length equal to $\lambda/2$ ($\lambda$ being the wavelength corresponding to the mean frequency of the pass band of the filter), which are open at both their extremities. Four single resonators $Q_1$ to $Q_4$ having a length equal to $\lambda'/4$ ($\lambda'$ being the wavelength in the filter corresponding to a frequency which is to be rejected by this filter) are connected respectively at one of their extremities to the middle of the straight resonators $L_1$ to $L_4$. Here again, as in the case of the preceding figures, the added resonators ($Q_1$ to $Q_4$) provide a band suppressor function at the frequency corresponding to the wavelength $\lambda'$. Equally, as in the case of the preceding figures, these added resonators are connected to the middle of the resonators providing the band pass function, that is to say where the electric field has its minimum value, in such manner as not to interfere with the band pass function of the filter.

Figure 5:
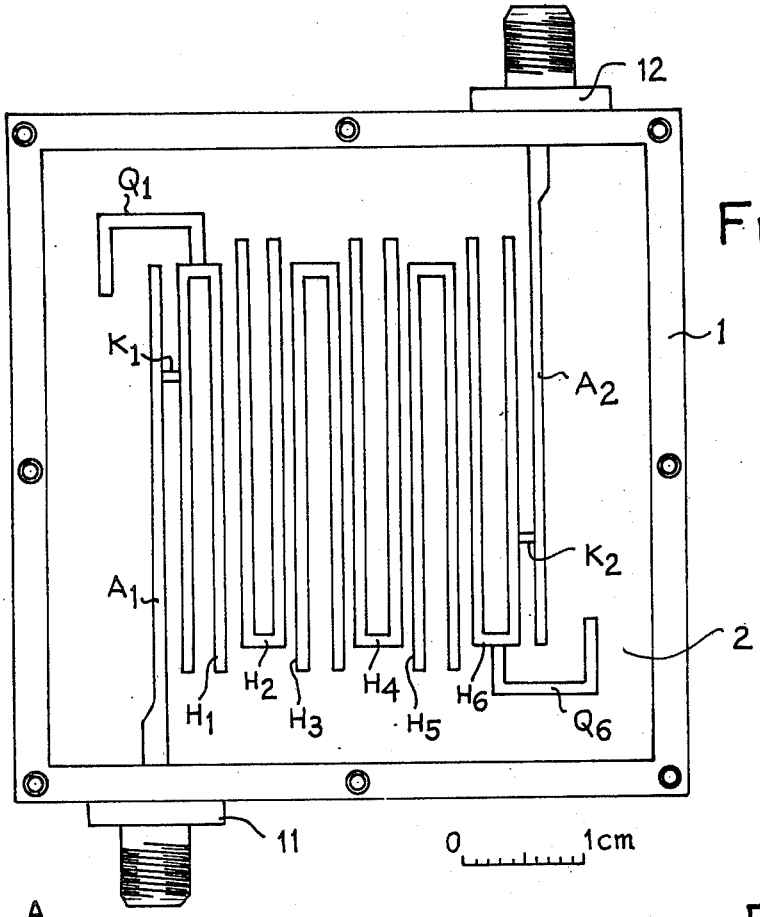
FIG. 5 is a view in detail of one form of filter according to the invention.

FIG. 5 is a detailed view of a filter according to the invention corresponding to the type illustrated by the diagram of FIG. 3. A scale graduated from 0 to 1 cm is placed beside the filter to show the enlargement ratio of the drawing.

In FIG. 5 is illustrated a housing 1 of which the cover removed to show the inside. This housing has associated with it two connectors 11, 12 of the co-axial type. Within the housing is situated a dielectric board 2 on which are situated the lines which, respectively, form:

- two mutually parallel filter access lines $A_1$,$A_2$ connected respectively to the internal conductor of the connectors 11 and 12.
- six U resonators $H_1$ to $H_6$ situated between the access lines $A_1$ and $A_2$ and of which the vertical bars are parallel to these same lines.
- and two single resonators $Q_1$ and $Q_6$ connected respectively at one of their extremities to the middle of the U resonators $H_1$ and $H_6$. It should be observed that in this embodiment, contrary to the illustration in FIG. 3, the resonators $Q_1$ and $Q_6$ are not straight like the resonators $Q_1$ and $Q_4$ but are curved in such a manner that they do not require a substrate of greater dimensions than the substrate needed to establish the access lines $A_1$ and $A_2$ and the U resonators $H_1$ to $H_6$.

In FIG. 5 are equally apparent two short circuits $K_1$ and $K_2$ which are connected respectively between the access line $A_1$ and the resonator $H_1$ and between the access line $A_2$ and the resonator $H_6$. These short circuits have been devised to provide a matching of the impedance of the filter as a function of the circuit in which this filter is intended to be installed.

Apart from what is shown in FIG. 5, the filter comprises—on the hidden surface of the dielectric substrate 2—a metal sheet connected electrically to the housing 1 and acting as an earthing plane. The external conductor of the connectors 11 and 12 is equally connected electrically to the housing 1.

Figure 6:
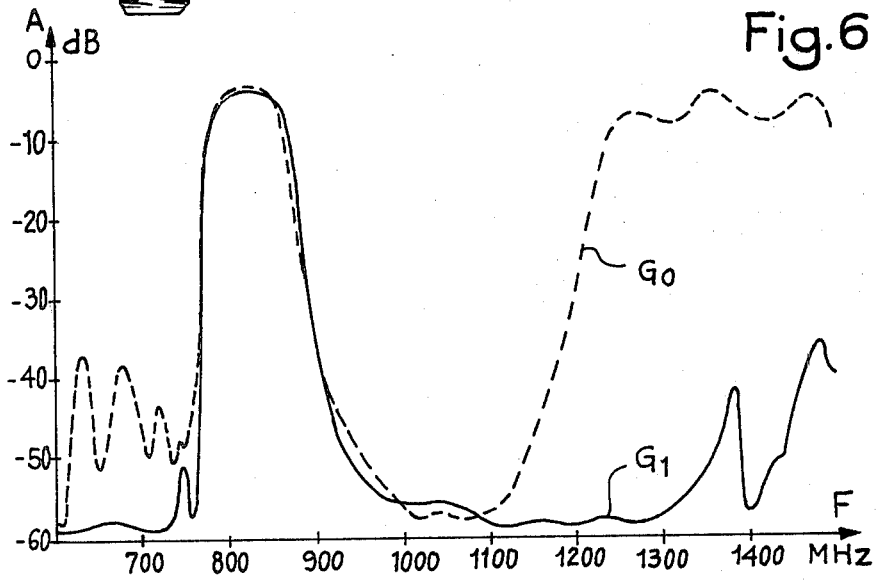
FIG. 6 is a graph relating partially to the filter according to FIG. 5

FIG. 6 is a graph showing the attenuation A provided as a function of the frequency by the filter according to FIG. 5 (solid-line trace $G_1$) and showing the attenuation provided by the band pass filter according to the prior art corresponding to the filter of FIG. 5, that is to say without the resonators $Q_1$ and $Q_6$ (broken-line trace $G_0$). The trace $G_0$ demonstrates that the conventional filter (lacking the resonators $Q_1$ and $Q_6$) has a band pass centered on a mean frequency of 825 MHz which is the useful band pass of the filter, meaning the pass band for which it was designed. This conventional filter equally has a pass band of which the lower frequency is situated at 1200 MHz and which forms a stray band pass which may be troublesome in particular applications. The trace $G_1$ of FIG. 6 shows that the addition of the resonators $Q_1$ and $Q_6$ to the other elements of the filter of FIG. 5 makes it possible to eliminate this stray pass band by establishing a band suppressor function.

Other band pass circuit embodiments may be contemplated without departing from the scope of the invention. For example, it is thus possible in the case of FIG. 1 for resonators identical to the resonators $P_1$ and $P_4$ to be associated with the resonators $H_2$ and $H_3$. Similarly, to establish the band suppressor function, it is possible for particular ones of the $\lambda/2$ resonators ($H_1H_2H_3H_4$) of FIG. 1 or of FIG. 3 to have connected to them U resonators having the length $\lambda'/2$, and for others of these $\lambda/2$ resonators to have connected to them single $\lambda'/4$ resonators like $Q_1$ and $Q_4$ (FIG. 3). It should equally be noted that the variable capacitors $C_1$ and $C_4$ of FIG. 2 may be replaced by fixed capacitors produced at the same time and in the same manner as the resonators, that is to say by means of metal deposits on a board or from a metallized board from which a part of the metal coating has been stripped by chemical or mechanical action on the same. These fixed capacitors are then formed by a row of parallel strips situated between the branches of the U of the resonators $P'_1$ and $P'_4$, perpendicular to these branches, two consecutive strips being integral with the two branches of the U respectively.

It should be noted that the central frequency of the band suppressor function integrated in a band pass filter may equally be a higher frequency than the pass band of the band pass filter, just as well as a lower frequency or even a frequency comprised within this pass band. It is sufficient to determine the electric length of the resonators which produce this band suppressor function, as a function of the wavelength of the central frequency of the band suppressor function which is to be obtained.

As a general rule, the number of resonators intended to add a predetermined band suppressor function within a band pass filter comprising linear resonators may be selected between 1 and n, n being the number of resonators establishing the band pass function of the filter in question. The selection of the number and of the position of the resonators intended to add the band suppressor function is a means of acting on the form of the filter response curve.

What is claimed is:

1. A filter having a band pass region whose mean wavelength is $\lambda$ and a band cut out for eliminating a frequency $\lambda'$, said filter comprising:

n main linear resonators wherein n is a positive integer at least equal to one and wherein each of said main linear resonators having a length equal to $\lambda/2$ and having two open extremities and a middle with said middle being at a location on said linear resonator where the electric field has a minimum value;

p auxiliary linear resonators wherein p is a positive integer at least equal to one and at most equal to n each having a length equal to one of $\lambda'/2$ and $\lambda'/4$ and each of said auxiliary linear resonators having two extremities and a middle with at least one of said extremities of said auxiliary resonators being open wherein said p auxiliary resonators are respectively connected to the middle of p of said main linear resonators.

2. A filter according to claim 1 wherein each of said main linear resonators is a U resonator formed substantially by two vertical bars and by a horizontal bar.

3. A filter according to claim 2 wherein each of said p auxiliary linear resonators is a U resonator formed substantially by two vertical bars and by a horizontal bar and in which the horizontal bars of said P auxiliary linear resonators are respectively connected to the horizontal bars of p of said main linear resonator.

4. A filter according to claim 1, wherein said p auxiliary linear resonators are respectively connected by one of their two extremities to said middle of said p main linear resonators.

* * * * *